US007467664B2

(12) United States Patent
Cochran et al.

(10) Patent No.: US 7,467,664 B2
(45) Date of Patent: Dec. 23, 2008

(54) PRODUCTION ACTUATED MUD FLOW BACK VALVE

(75) Inventors: Travis E. Cochran, Houston, TX (US); Jason M. Visosky, Houston, TX (US); Elmer Richard Peterson, Porter, TX (US)

(73) Assignee: Baker Hughes Incorporated, Houston, TX (US)

( * ) Notice: Subject to any disclaimer, the term of this patent is extended or adjusted under 35 U.S.C. 154(b) by 26 days.

(21) Appl. No.: 11/644,525

(22) Filed: Dec. 22, 2006

(65) Prior Publication Data

US 2008/0149350 A1 Jun. 26, 2008

(51) Int. Cl.
*E21B 34/08* (2006.01)

(52) U.S. Cl. ..... 166/386; 166/332.1; 166/334.4

(58) Field of Classification Search ..... 166/386, 166/332.1, 334.1, 334.4
See application file for complete search history.

(56) References Cited

U.S. PATENT DOCUMENTS

| | | | |
|---|---|---|---|
| 3,420,363 | A | 1/1969 | Blickensderfer |
| 3,918,523 | A | 11/1975 | Stuber |
| 4,137,970 | A | 2/1979 | Laflin et al. |
| 4,612,985 | A | 9/1986 | Rubbo et al. |
| 4,640,354 | A | 2/1987 | Boisson |
| 4,862,967 | A | 9/1989 | Harris |
| 4,919,989 | A | 4/1990 | Colangelo |
| 4,936,386 | A | 6/1990 | Colangelo |
| 4,990,545 | A | 2/1991 | Hourai et al. |
| 5,048,605 | A | 9/1991 | Toon et al. |
| 5,049,591 | A | 9/1991 | Hayashi et al. |
| 5,145,935 | A | 9/1992 | Hayashi |
| 5,195,583 | A | 3/1993 | Toon et al. |
| 5,199,497 | A | 4/1993 | Ross |
| 5,558,153 | A | 9/1996 | Holcombe et al. |
| 5,687,795 | A | 11/1997 | Patel et al. |
| 5,906,238 | A | 5/1999 | Carmody et al. |
| 6,032,733 | A | 3/2000 | Ludwig et al. |

(Continued)

FOREIGN PATENT DOCUMENTS

| | | |
|---|---|---|
| DE | 3700717 | 7/1988 |

(Continued)

OTHER PUBLICATIONS http://www.alchemycastings.com/lead-products/fusible.htm.

(Continued)

*Primary Examiner*—Giovanna C Wright
(74) *Attorney, Agent, or Firm*—Steve Rosenblatt

(57) ABSTRACT

A material that reacts to produced hydrocarbons acts as a latch to retain a stored potential energy force. In a specific application, a sliding sleeve valve is held away from a circulating port to allow drilling mud to be circulated out. Later, when the well is put on production, the lock that holds collets in a groove releases as exposure to produced hydrocarbons at a retaining sleeve makes it get soft. This, in turn, allows a spring force to run the collets out of their groove and straddle the circulation port between two o-rings on the shifting sleeve to close the port. The closure of the port directs produced hydrocarbons to screens that had been bypassed when mud was circulated out due to ports being the path of least resistance.

16 Claims, 1 Drawing Sheet

U.S. PATENT DOCUMENTS

| | | | | |
|---|---|---|---|---|
| 6,073,692 | A | 6/2000 | Wood et al. | |
| 6,354,379 | B2 | 3/2002 | Miszewski et al. | |
| 6,425,443 | B1 | 7/2002 | Hill et al. | |
| 6,583,194 | B2 | 6/2003 | Sendijarevic | |
| 6,817,441 | B2 | 11/2004 | Murakami et al. | |
| 6,834,725 | B2 | 12/2004 | Whanger et al. | |
| 6,848,505 | B2 | 2/2005 | Richard et al. | |
| 6,854,522 | B2 | 2/2005 | Brezinski et al. | |
| 6,976,542 | B2 * | 12/2005 | Henriksen et al. | 166/386 |
| 2001/0001420 | A1 | 5/2001 | Miszwenski et al. | |
| 2003/0116315 | A1 | 6/2003 | Wellington et al. | |
| 2004/0020662 | A1 | 2/2004 | Freyer | |
| 2004/0055760 | A1 | 3/2004 | Nguyen | |
| 2004/0118572 | A1 | 6/2004 | Whanger et al. | |
| 2004/0194971 | A1 | 10/2004 | Thomson | |
| 2004/0216887 | A1 | 11/2004 | Bertelsen | |
| 2004/0261990 | A1 | 12/2004 | Bosma et al. | |
| 2005/0067170 | A1 | 3/2005 | Richard | |
| 2005/0092363 | A1 | 5/2005 | Richard et al. | |
| 2005/0110217 | A1 | 5/2005 | Wood et al. | |
| 2006/0042798 | A1 | 3/2006 | Badalamenti et al. | |
| 2006/0175065 | A1 | 8/2006 | Ross | |
| 2007/0012434 | A1 | 1/2007 | Riggenberg | |
| 2007/0044962 | A1 | 3/2007 | Tibbles | |
| 2007/0125532 | A1 | 6/2007 | Murray | |
| 2007/0137865 | A1 | 6/2007 | Farrar et al. | |
| 2007/0144731 | A1 | 6/2007 | Murray | |
| 2007/0246213 | A1 * | 10/2007 | Hailey, Jr. | 166/278 |
| 2007/0246225 | A1 * | 10/2007 | Hailey et al. | 166/386 |

FOREIGN PATENT DOCUMENTS

| | | | |
|---|---|---|---|
| GB | 851365 | | 10/1960 |
| GB | 2328463 | | 2/1999 |
| GB | 2411918 | | 9/2005 |
| GB | 2416796 | | 2/2006 |
| GB | 2421527 | A | 6/2006 |
| GB | 2421746 | | 7/2006 |
| JP | 03166459 | | 12/1992 |
| JP | 07334115 | | 6/1997 |
| JP | 10235996 | | 2/2000 |
| WO | 9958809 | | 11/1999 |
| WO | 2004018836 | | 3/2004 |
| WO | 2005/035937 | A1 | 4/2005 |
| WO | 2005035937 | | 4/2005 |
| WO | 2006015277 | | 2/2006 |
| WO | 2007124374 | | 11/2007 |

OTHER PUBLICATIONS http://www.solders.com/low_melt_alloys.htm.

* cited by examiner

PRODUCTION ACTUATED MUD FLOW BACK VALVE

FIELD OF THE INVENTION

The field of this invention relates to downhole tools and more specifically valves that are released to actuate by exposure of the release mechanism to produced well fluids.

BACKGROUND OF THE INVENTION

A frequent occurrence in drilling a well includes a need to circulate out the mud used during drilling with a different weight mud before production is started. In other procedures, the production string with screens is run into the mud and the mud is displaced with production. The problem here is that the mud can clog the production screens.

Previous efforts employed a swelling material sensitive to well fluids to block a fluid passageway have raised concerns about long term reliability of the material to act as a flow barrier over time. The problem with swelling materials as differential pressure seals is that when they swell they also get very soft and their ability to withstand differential pressures is reduced.

The present invention uses such materials but in a manner where the fact that they get soft is a plus to the operation of the tool into which they are incorporated. In essence, the swelling material that is selected is responsive to produced hydrocarbons to release a latch so that the tool can operate. In an embodiment of a circulation sub, a sliding sleeve with o-ring seals is held open against a closure force by a collet latch. The collets become unsupported when exposed to produced hydrocarbons to close a bypass port previously used to displace drilling mud around the production screens. The softening of the material unlocks the collets from a retaining groove so that an energy source, such as a spring, can push the sleeve to straddle a port with o-rings on a shifting sleeve. These and other aspects of the present invention will be more apparent to those skilled in the art from the description of the preferred embodiment below and the associated drawings, while recognizing that the full scope of the invention is to be found in the claims.

SUMMARY OF THE INVENTION

A material that reacts to produced hydrocarbons acts as a latch to retain a stored potential energy force. In a specific application, a sliding sleeve valve is held away from a circulating port to allow drilling mud to be circulated out. Later, when the well is put on production, the lock that holds collets in a groove releases as exposure to produced hydrocarbons at a retaining sleeve makes it get soft. This, in turn, allows a spring force to run the collets out of their groove and straddle the circulation port between two o-rings on the shifting sleeve to close the port. The closure of the port directs produced hydrocarbons to screens that had been bypassed when mud was circulated out due to ports being the path of least resistance.

DETAILED DESCRIPTION OF THE PREFERRED EMBODIMENT

Figure 1:
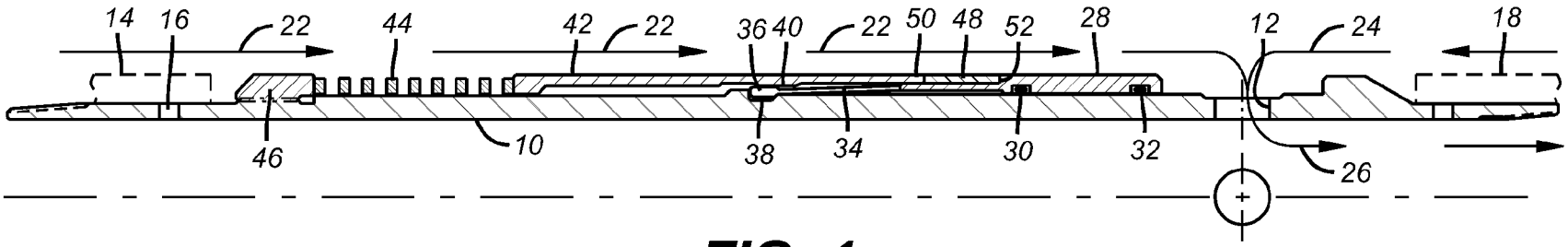
FIG. 1 is a section view with the port open.

FIG. 1 shows a tubular 10 that is part of a production string going to the surface. It features a port 12 that is open during run in of the production string. The production string also has a screen section 14 that communicates through port 16 into the production string. It can have another screen section 18 and an associated port or ports 20 above port 12.

When the production string is run in the hole, the drilling mud is still there. The productions screens 14 or 18 would clog if the production from the formation passed through them forcing the mud in the hole to also go through the screen. In some applications, the drilling mud in the hole is simply displaced by production. In that instance it is desirable to bypass the screens 14 and 18 until the majority of the mud has been displaced and after that time to direct the well production through those very same bypassed screens. FIG. 1 illustrates this concept. Arrows 22 represent production coming uphole to the open port 12. Since that is a path of least resistance, the production flow bypasses screens 14 on the way up to port 12. The same thing happens to the mud in the annular space outside screen sections 18 as shown by arrow 24. There the path of least resistance, when the well is put into production is to flow downhole to port 12 rather than through the screen 18 and then through port 20. Arrow 26 indicates the combined flow represented by arrows 22 and 24 going uphole. This flow is initially drilling mud and eventually produced fluids. The trick is to know when that change happens and close port 12 to direct what is then produced fluids only through the screens 14 and 18.

Figure 2:
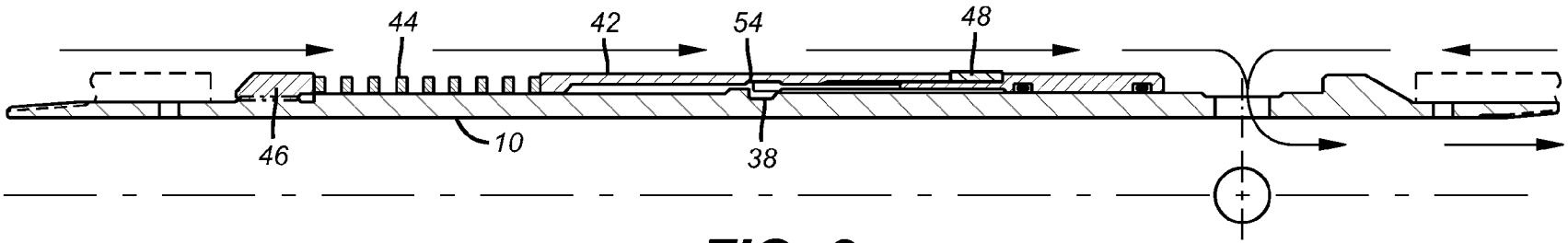
FIG. 2 is the view of FIG. 1 after exposure to produced fluids has let the collets come out of their retaining groove.
Figure 3:
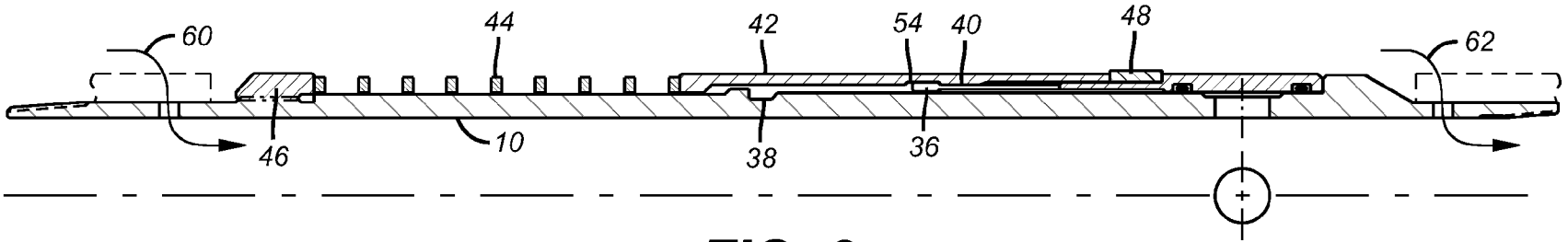
FIG. 3 is the view of FIG. 2 with the spring shifting the sleeve to close off the circulation port.

The issue with this technique is to know when the mud is close to fully displaced, which makes it safe for the production to be directed through the screens 14 and 18 with little risk of plugging such screens with drilling mud. The remaining structure in FIG. 1 explains how this happens automatically. A sliding sleeve 28 has a pair of spaced apart seals 30 and 32. Extending from sleeve 28 is a series of collet fingers 34 that terminate in heads 36 held in groove 38 of the tubular 10 by a projection 40 on sleeve 42. Sleeve 42 is biased by spring 44 and bears on threaded ring 46. An oleophillic elastomer 48 keeps the lower end 50 of sleeve 42 from moving down to surface 52 on sleeve 28. As long as elastomer 48 remains structurally rigid the collet heads 36 are trapped in groove 38 and sleeve 28 can't move. After production displaced the mud from around the elastomer 48, the production hydrocarbons contact the elastomer 48 and cause it to swell as well as to get very soft, as shown in FIG. 2. This quality of the elastomer 48 when so exposed allows spring 44 to compress material 48 and to move sleeve 42 thus moving ridge 40 to an offset position with respect to collet heads 36 so as to allow them to escape from groove 38 and get captured in groove 54 of sleeve 42 now moving under the force of the spring 44. The force of spring 44 simply shifts the sleeve 42 and the now captured sleeve 28 to shift sleeve 28 until the seals 30 and 32 straddle port 12. At this point, production flow will go through the screens 14 and 18, as shown in FIG. 3 by arrows 60 and 62, without fear of clogging them with drilling mud as the presence of produced hydrocarbons at elastomer 48 indicates that the drilling mud has been effectively displaced by produced fluid. Normal production through screens 14 and 18 now follows.

Those skilled in the art will appreciate that while a configuration showing trapped potential energy released by weakening of the material 48 is illustrated that other applications are envisioned where the exposure to a predetermined well fluid accomplishes the actuation in other ways. The driving force, if stored potential energy is used does not need to be a spring. It could be other forms of stored energy that are unleashed to accomplish tool movement such as pressurized gas or a stack of Belleville washers, to name a few examples. While the preferred embodiment is a bypass for other well equipment that closes when a condition in the well is met, the invention encompasses opening a bypass instead or not even using a bypass and simply moving a part on a tool directly in response to presence of a material. While the locking system is shown as trapped collet heads being liberated on exposure of material 48 to a predetermined fluid, other types of locking devices that are defeated by a softening or dimensional change in material 48 are contemplated within the scope of the invention.

The above description is illustrative of the preferred embodiment and various alternatives and is not intended to embody the broadest scope of the invention, which is determined from the claims appended below, and properly given their full scope literally and equivalently.

We claim:

1. A downhole assembly, comprising:

a housing supporting a downhole tool said tool capable of passing flow therethrough;

a port through said housing and a valve member adjacent said port to selectively have said port open or closed;

an actuating device on said housing operably connected to said valve member, said actuating device only moving said valve member in response to contact of said actuating device by a predetermined well fluid, whereupon flow through or bypassing said downhole tool is altered;

said actuating device comprises a potential energy source retained on said housing from affecting said valve member by a lock member that responds to contact by said predetermined well fluid in order to release said potential energy source for movement of said valve member.

2. The assembly of claim 1, wherein:

said lock member comprises a material that gets softer on exposure to said predetermined fluid.

3. The assembly of claim 2, wherein:

said lock member comprises an oleophillic elastomer.

4. The assembly of claim 1, wherein:

said lock member comprises a material that changes dimensions when exposed to said predetermined fluid.

5. The assembly of claim 1, wherein:

said predetermined fluid is produced fluids from the wellbore.

6. A downhole assembly, comprising:

a housing supporting a downhole tool said tool capable of passing flow therethrough;

a port through said housing and a valve member adjacent said port to selectively have said port open or closed;

an actuating device on said housing operably connected to said valve member, said actuating device only moving said valve member in response to contact of said actuating device by a predetermined well fluid, whereupon flow through or bypassing said downhole tool is altered;

said actuating device comprises a material that gets softer on exposure to said predetermined fluid;

said actuating device comprises a potential energy stored force that is released when said material gets softer;

said stored force is retained by at least one collet held in a groove until said material softens.

7. The assembly of claim 6, wherein:

said collet is retained in a first groove by a sleeve that is prevented from shifting until said material gets softer.

8. The assembly of claim 7, wherein:

said sleeve is biased by a spring and further comprises a second groove to engage said collet as softening of said material allows it to move.

9. The assembly of claim 8, wherein:

said collet is connected to said valve member for closing said port in the presence of hydrocarbons produced downhole.

10. A downhole completion method, comprising:

running into a wellbore containing a drilling mud a screen on a tubular assembly and a bypass port into the tubular assembly apart from said screen;

positioning said bypass port in a first position while bringing in the well;

holding back a stored potential energy force with a lock that can release said potential energy in response to exposure to a predetermined well fluid;

using the proximity of said predetermined well fluid near said lock to place said bypass port in a second position.

11. The method of claim 10, comprising:

using produced fluid to release said stored potential energy force to close said bypass port.

12. A downhole completion method, comprising:

running into a wellbore containing a drilling mud a screen on a tubular assembly and a bypass port into the tubular assembly apart from said screen;

keeping said bypass port open while bringing in the well; and using the proximity of produced well fluid near said bypass port to close said bypass port;

using produced fluid to release a stored potential energy source to close said bypass port;

locking said potential energy source from moving a valve member with respect to said bypass port using a material that responds to produced well fluids.

13. The method of claim 12, comprising:

using a material that changes characteristics to let said potential energy source move a sleeve to engage a valve member whose movement covers said bypass port.

14. The method of claim 13, comprising:

initially trapping said valve member to said tubular assembly:

using movement of said sleeve to engage the valve member to said sleeve for tandem movement under the force of the liberated potential energy source.

15. The method of claim 12, comprising:

using an oleophillic elastomer for said material.

16. The method of claim 12, comprising:

using a material that either gets softer or changes dimensions in the presence of produced well fluids.

* * * * *